US007533780B2

(12) United States Patent
Daugherty, Jr.

(10) Patent No.: US 7,533,780 B2
(45) Date of Patent: May 19, 2009

(54) SPHERICAL BALL/RACE IN COUPLER BUTT

(75) Inventor: David W. Daugherty, Jr., Crown Point, IN (US)

(73) Assignee: WABTEC Holding Corp., Wilmerding, PA (US)

( * ) Notice: Subject to any disclaimer, the term of this patent is extended or adjusted under 35 U.S.C. 154(b) by 496 days.

(21) Appl. No.: 11/147,089

(22) Filed: Jun. 7, 2005

(65) Prior Publication Data

US 2006/0273058 A1 Dec. 7, 2006

(51) Int. Cl.
*B61G 9/00* (2006.01)

(52) U.S. Cl. ..... 213/62 R

(58) Field of Classification Search ..... 213/75 R, 213/62 R, 63, 64, 77; 105/3, 4.1; 29/898.43; 104/3, 4.1

See application file for complete search history.

(56) References Cited

U.S. PATENT DOCUMENTS 6,176,379 B1 * 1/2001 Daugherty, Jr. ..... 213/75 R 7,213,718 B2 * 5/2007 Ring ..... 213/62 R

* cited by examiner

*Primary Examiner*—S. Joseph Morano
*Assistant Examiner*—Robert J McCarry, Jr.
(74) *Attorney, Agent, or Firm*—James Ray & Assoc.

(57) ABSTRACT

A slackless coupler assembly having a ball and race assembly provided in the coupler butt. The ball and race assembly comprises a ball member having a substantially spherical shape and a one piece race member which is formed integrally with at least a portion of the ball member in a manner so as to enable rotational movement of the ball member with respect to the one piece race member. The outer surface of the one piece race member has a shape which is capable of being placed within an aperture of a male connection member so as to enable rotational movement of the male connection member with respect to a female connection member. A telescoping spring is provided to maintain the coupler knuckle in a substantially vertical direction. A slackless coupler assembly of the present invention eliminates the need for expensive draft gears.

20 Claims, 7 Drawing Sheets

SPHERICAL BALL/RACE IN COUPLER BUTT

FIELD OF THE INVENTION

The present invention relates, in general, to railway type car couplers utilized at the present time in the railroad industry to connect adjacently disposed ends of a pair of cars together in a train consist and, more particularly, the instant invention relates to an improved type of slackless coupler eliminating the need for expensive and heavy draft gears and, still more particularly, this invention relates to an improved slackless coupler employing a spherical ball and race assembly disposed within its butt.

BACKGROUND OF THE INVENTION

The majority of the railway type car coupling arrangements for joining adjacent ends of a pair of such cars are predominantly divided into either joining such railway cars in a substantially semi-permanent fashion such as drawbars or articulated couplings or joining in a temporary fashion, such as standard couplers.

Use of standard AAR (Association of American Railroads) couplers, generally type E or F, to join railroad cars is well known. Such couplers are designed to facilitate the connecting or disconnecting of individual railway cars allowing the cars to be readily combined to make a train or individually separated for loading or unloading.

The greater loads carried by modern railway cars necessitated maintenance of the close-butted relationships between various components to lessen the impact forces on railway cars and the coupling arrangements. As a result, closed buttoned relationships lead to development of slackless coupling arrangements primarily consisting of couplers and drawbars.

The primary advantage of the coupler generally used with a draft gear assembly is that it accommodates the longitudinal travel in both directions, as well as the vertical and lateral travel at the coupling as the railway cars progress along the track and, more particularly, enabling such cars to more easily negotiate the curved portion of the track which will be encountered during operation.

One type of such coupler arrangement is illustrated in U.S. Pat. No. 5,312,007 and includes a draft gear to absorb the load on a railroad car coupler in both the buff and draft directions of travel. The draft gear avoids shock-loading from sudden acceleration in the draft direction for couplers, while retaining the shock-loading or shock-absorbing capability of the assembly in the buff direction, especially for freight cars being humped.

Another type of coupler arrangement is illustrated in U.S. Pat. No. 4,480,758 and includes modification of the conventional yoke and draft gear enabling a larger draft gear to be positioned within the sill. A railway coupler arrangement includes a center sill having front and rear draft lugs within the sill. A draft gear housing is carried within the sill and is slideable between the front and rear draft lugs. A follower and plunger block is slideable in the center sill and is in engagement with one end of a draft gear. A yoke shank is provided with a butt engageable with the aforesaid follower and plunger block and is movable from a position where it engages forward wall means on the draft gear housing during draft loads to a position removed from the forward wall means where it forces the follower and plunger block into the draft gear during buff loads. Means are associated with the front draft lugs for engaging the follower and plunger block during draft loads to compress the draft gear.

A rotary coupler arrangement is also known in which the railway coupler shank includes a butt end which extends into the draft gear housing and is engageable with a cooperating spherical surface on the follower and plunger block. With an arrangement of this sort, the rotary coupler butt end is disposed aft of the front draft gear lugs on the sills and is positioned in a substantially horizontal plane for ease of coupling and uncoupling.

The primary disadvantage of the coupler and draft gear assembly is the weight of the draft gear. An additional disadvantage of the coupler and the draft gear assembly is the high unit cost of the draft gear due to the complexity of the design and a requirement for a significant number of components.

Lately, slackless drawbar assemblies have substantially eliminated the need for a relatively expensive draft gear assembly. Furthermore, these slackless drawbar assemblies have generally resulted in a desirable overall net decrease in the empty weight of such railway freight cars as well as an overall decrease in unit cost. Decrease in empty weight allows either reduced fuel costs when such railway freight cars are being hauled or an increase in weight of the net load being hauled.

One type of such slackless drawbar is taught in U.S. Pat. No. 5,547,089 and includes a female connection member with one end engaging an end of a car body center sill and another end extending outwardly from the center sill end and a male connection member having a first end movably disposed in such cavity and a second end for coupling to a male connection member of the adjacent railway vehicle. An aperture is formed through such male connection member first end. A cavity formed in such other end of the female connection member defined by inner surfaces of the back wall, top wall and pair of side walls having openings and open at a bottom and outer end thereof. A portion of a spherical shaped ball member having a pair of shaft members extending from outer surfaces is disposed in such aperture. A portion of each shaft member is disposed in respective side wall openings. Each shaft member has a flat surface formed thereon. A race has a portion thereof disposed in such aperture and is secured to such male connection member. The race inner surface is disposed around the spherical member.

Another type of such slackless coupling arrangement is taught in U.S. Pat. No. 6,176,379 and includes a ball and race assembly having a one piece race assembly integrally formed onto the ball. The ball and race assembly includes a ball member having a spherical shape with a predetermined diameter and a one piece race member which is formed integrally with at least a portion of the ball member in a manner so as to enable rotational movement of the ball member with respect to the race member. The race member is a filament wound composite type material which is wound about the ball member so as to produce an outer surface which is capable of being positioned within an appropriate holding device. The outer surface of the race member has a shape which is capable of being placed within an aperture of a male connection member in a railway coupling device so as to enable rotational movement of the male connection member with respect to a car connection member of the coupling device.

The teachings of U.S. Pat. Nos. 5,547,089 and 6,176,379 are incorporated in this application by reference thereto.

SUMMARY OF THE INVENTION

A slackless coupler assembly having a ball and race assembly provided in the coupler butt. Such slackless coupler assembly includes a female connection member engaged with and secured to the center sill of a railway vehicle. A male connection member has a first end, having an aperture formed therein, disposed within such cavity and a second end having a coupler knuckle. A connection means at least partially disposed within the aperture pivotably joins such male connection member to such female connection member. Coupler bias means being a telescoping spring are further provided for maintaining the coupler knuckle in a substantially vertical direction. The telescopic spring is pivotably coupled to the female connection member at one end and to the male connection member at the distal end. The ball and race assembly includes a ball member having a substantially spherical shape and a race member to enable rotational movement of the ball member with respect to the race member. The outer surface of the race member has a shape which is capable of being placed within an aperture of a male connection member so as to enable rotational movement of the male connection member with respect to a female connection member. Locking wedges engaging the shaft members horizontally disposed on either side of the spherical ball member are used to prevent movement of such shaft members and further prevent movement of the male connection member while enabling the rotation of such male connection member.

OBJECTS OF THE INVENTION

It is a primary object of the present invention to provide a slackless coupler assembly that allows separating adjacent railway cars during service.

A further object of the present invention is to provide a slackless coupler assembly that minimizes weight by eliminating draft gears.

Another object of the present invention is to provide a slackless coupler assembly that maintains a coupler knuckle in a substantially vertical direction.

An additional object of the present invention is to provide a slackless coupler assembly utilizing a ball and race assembly to enable slackless operation.

Although a number of objects and advantages of the present invention have been described in some detail above, various additional objects and advantages of the slackless coupler having a ball and race assembly of the present invention will become more readily apparent to those persons who are skilled in the art from the following more detailed description of the invention, particularly when such detailed description of the invention is taken in conjunction with both the attached drawing figures and with the appended claims.

DETAILED DESCRIPTION OF VARIOUS EMBODIMENTS OF THE INVENTION

Figure 1:
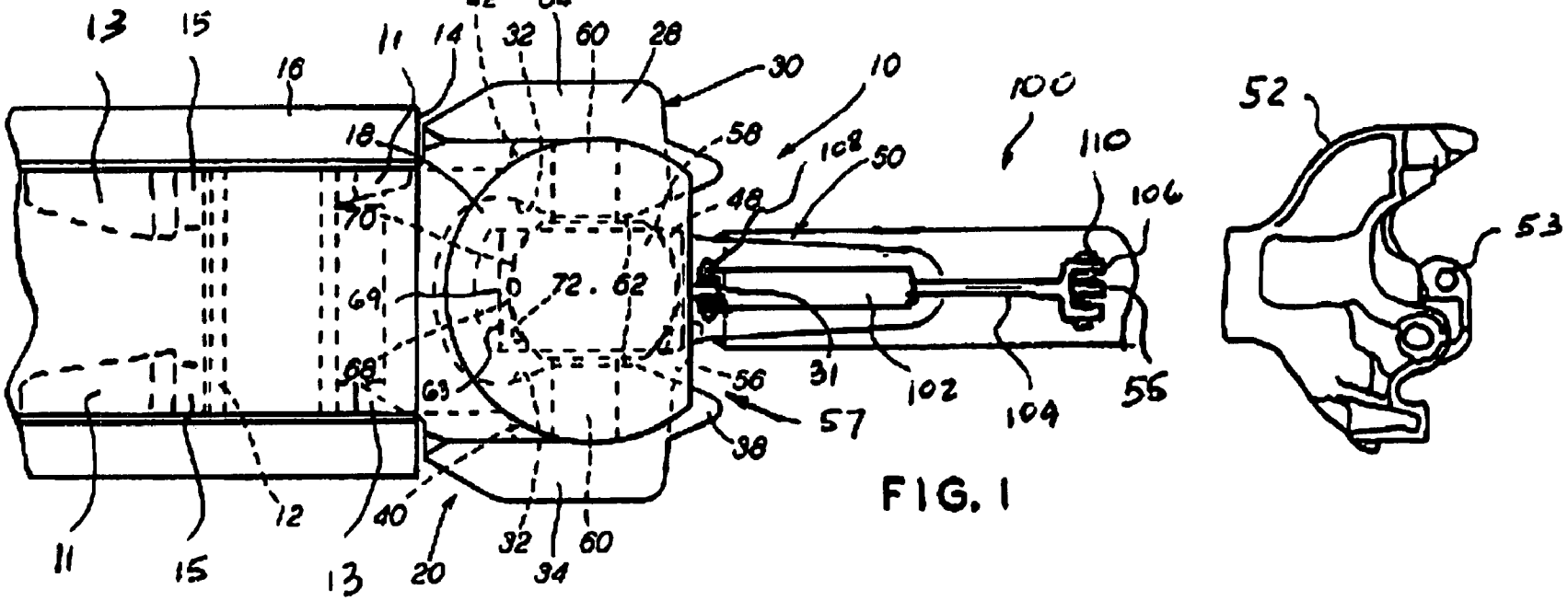
FIG. 1 is a top view which illustrates one presently preferred embodiment of the improved slackless coupler assembly constructed according to the present invention.

Prior to proceeding with the more detailed description of the invention it should be noted that for the sake of clarity and understanding the invention, identical components which have identical functions have been identified with identical reference numerals throughout the several views illustrated in the attached drawing Figures.

Figure 2:
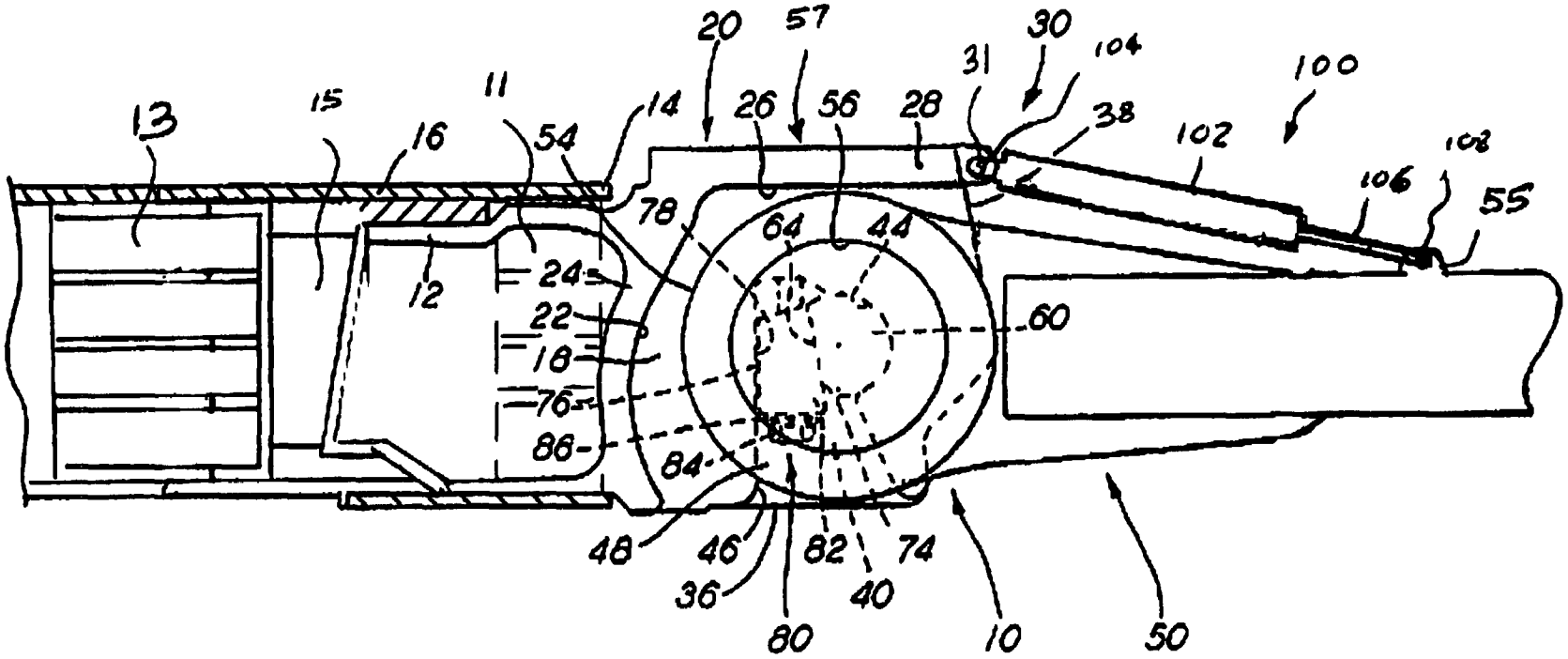
FIG. 2 is a side elevation view, partially in cross section, of such improved slackless coupler assembly illustrated in FIG. 1.

Now reference is made, more particularly, to the attached drawing FIGS. 1 and 2. Illustrated therein is a first presently preferred embodiment of a slackless type coupler assembly, generally designated 10.

Such slackless coupler assembly 10 includes a female connection member, generally designated 20, having a first end 12 of a first predetermined configuration enabling the first end 12 to be disposed within and engaged to an outer end portion 14 of a center sill member 16 disposed on a bottom portion of a car body member (not shown) of a railway car (not shown). Such first end 12 can be attached to the center sill 16 by a variety of known methods, such as welding or use of a mounting plate. Additionally a pair of front and a pair of rear draft stops 11 and 13, respectively, and a second pair of locking wedges 15 may be provided to constantly take up the slack when component wear occurs subsequently increasing longitudinal clearances between the front and rear draft stops 11 and 13, respectively, and the female connection member 20.

The locking wedges 15 may be separate members or may be a single machined or cast piece wherein the locking wedges are connected by a bridge member (not shown).

Such female connection member 20 further includes a radially opposed second end 30 which extends outwardly from such outer end portion 14 of the center sill member 16.

A cavity 18 is formed in the radially opposed second end 30 of such female connection member 20. Such cavity 18 has an inner surface 22 of a back wall portion 24, having a second predetermined configuration, an inner surface 26 of a top wall portion 28 and an inner surface 32 of a pair of side wall portions 34, each side wall portion 34 having a third predetermined configuration. Accordingly, cavity 18 is open adjacent at least a portion of a bottom 36 and an outer end 38 of the radially opposed second end 30 of such at least one female connection member 20. A first pivot 31 is disposed about the middle of such top wall portion 28. In the presently preferred embodiment, the second predetermined configuration of such inner surface 22 will be generally concave in at least one of a vertical direction and a horizontal direction.

In a still more preferred embodiment, the second predetermined configuration of such inner surface will be generally concave in both such vertical direction and such horizontal direction. In addition, the third predetermined configuration of such inner surfaces 32 will, preferably, be generally convex shaped in at least a horizontal direction. In the more preferred embodiment of the invention, as has been clearly illustrated in the drawing Figures, the third predetermined configuration of such inner surfaces 32 will be generally convex shaped in both such horizontal vertical directions.

There is a first opening 40, having a fourth predetermined configuration, formed through a first one of such pair of side wall portions 34. Additionally, there is a radially opposed second opening 42, having a fifth predetermined configuration, formed through a second one of such pair of side wall portions 34. In the presently preferred embodiment, the fourth predetermined configuration of such first opening 40 and such fifth predetermined configuration of the radially opposed second opening 42 will at least include a generally round portion 44 and a generally open bottom portion 46.

Slackless coupler assembly 10 further includes male connection member, generally designated 50, having a sixth predetermined configuration. Male connection member 50 includes a first end 48 and a radially opposed second end 52 having a coupler knuckle 53. At least a portion of such first end 48 being movably disposed within such cavity 18 formed in the radially opposed second end 30 of such at least one female connection member 20. Preferably, the first end 48 will include an inner end surface 54, which is disposed facing the inner surface 22 of such back wall portion 24 of the cavity 18, which is convex shaped in at least one of a vertical direction and a horizontal direction. It is even more preferred that such first end 48 be convex shaped in both such vertical and horizontal directions. A second pivot 55 is disposed within such male connection member 50 intermediate the first end 48 and the second end 52.

An aperture 56 is formed through a predetermined portion of male connection member 50 adjacent the first end 48 thereof. Preferably, such aperture 56 will be generally round and will have a first predetermined diameter.

The slackless coupler assembly 10 further includes a connection means, generally designated 57, for pivotably joining the male connection member 50 to the female connection member 20. The connection means 57 having a spherical shaped member 58 disposed at least partially within such aperture 56. There is a pair of substantially horizontally disposed shaft members 60 extending outwardly for a predetermined distance from radially opposed and substantially vertically disposed outer surfaces 62 of such spherical shaped member 58. At least a portion of a first one of such pair of horizontally disposed shaft members 60 being disposed within such first opening 40 formed through the first one of such pair of side wall portions 34 and at least a portion of a second one of the pair of horizontally disposed shaft members 60 being disposed within such second opening 42 formed through the second one of such pair of side wall portions 34. Each respective one of such pair of shaft members 60 includes a radially opposed and substantially flat surface portion 64 formed thereon.

According to a presently preferred embodiment, the spherical shaped member 58 and the pair of horizontally disposed shaft members 60 will be formed as an integral single piece, preferably, as a forging. Additionally, such spherical shaped member 58 will include a chrome plating on at least a portion of an outer surface thereof. Such at least a portion of such chrome plated outer surface of the spherical shaped member 58 will, preferably, be polished.

A race member 63 is provided to secure the spherical shaped member 58 to such first end 48 of the male connection member 50. In this arrangement, at least a portion of such race member 63 is disposed within the aperture 56 in a position such that an inner surface 68 of such race member 63 is disposed around at least a portion of such spherical shaped member 58 disposed within the aperture 56 formed in such first end 48 of such at least one male connection member 50. Such race member 63 will be secured in a manner such that it can be readily removed from the first end 48 of such male connection member 50.

Figure 3:
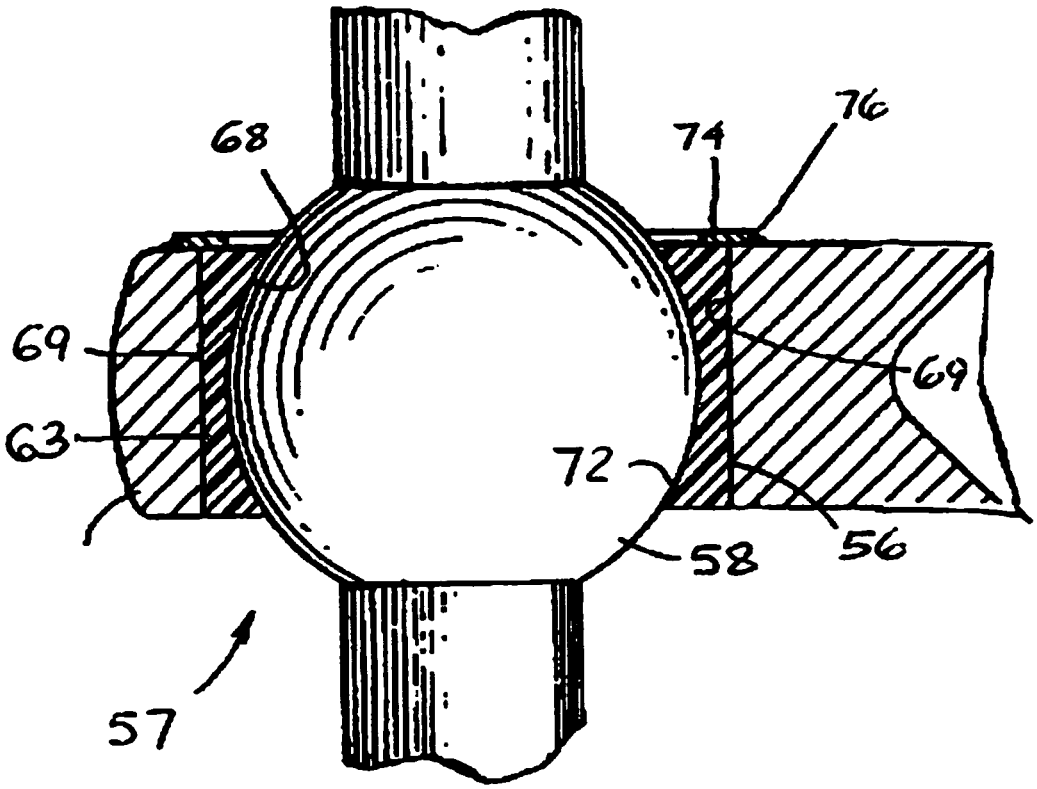
FIG. 3 is a partial view of the connection assembly of the present invention, particularly illustrating a one piece race member.

In the presently preferred embodiment race member 63, best shown in FIG. 3, is a one piece race member 63 formed integrally with spherical shaped member 58 and encircles at least a portion of the spherical member 58. The spherical shaped member 58 forms a part of a mold upon which the race member 63 is molded. The outer surface 69 of the race member 63 has a configuration which allows the spherical shaped member 58 having the race member 63 thereon to be fitted within the aperture 56. In a presently preferred embodiment, the outer surface 69 of the one piece race member 63 will abut the inner surface of the aperture 56 formed in the male connection member 50.

The securing of the one piece race member 63 within the aperture 56 of the male connection member 50 can be achieved with a mechanical securing means, such as a circular ring 74 which is secured, such as by welding, along the interface surface area 76.

Any well known technique and/or material may be used to integrally form the one piece race member 63 with the spherical shaped member 58 as long as the resultant connection assembly has predetermined strength to withstand the forces generated by in-track service and the rotation of the substantially spherical member 58 against the race member 63, as well as the resultant assembly having predetermined lubricity to substantially minimize friction forces during the rotation of such substantially spherical member 58 within such one piece race member 63.

Figure 4:
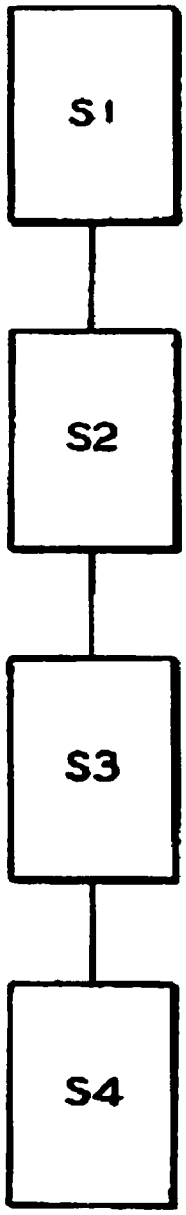
FIG. 4 illustrates forming the one piece race member illustrated in FIG. 3.

In a presently preferred embodiment, one piece race member 63 can be formed of a polymeric and/or composite material and integrally formed onto the spherical member by filament winding. For example, as shown in FIG. 4 the one piece race member 63 can be formed by (S1) placing a lubricating means 70 such as Teflon.RTM./Dacron.RTM. yarn mesh base about the outer surface 72 of the spherical shaped member 58 and (S2) filament winding a resin impregnated reinforcing material, such as epoxy impregnated glass about the base, (S3) curing the resin in the fibers, and (S4) machining the race member 63 to the desired size.

Teflon.RTM., and/or polytetrafluoroethylene, also known as PTFE, and Dacron.RTM., also known as polyester, are registered trademarks of E.I. Dupont De Nemours. The Dacron.RTM. yarns enable the resin impregnated fibers to bond to the desired shape while the Teflon.RTM. yarns provide a nonstick surface which will provide sufficient lubrication between the outer surface 72 of the spherical shaped member 58 and the inner surface 68 of the one piece race member 63. This type of material has especially good strength and lubricating abilities which allows for unrestricted movement of the spherical shaped member 58 thereagainst.

In an alternative embodiment, such lubricating means 70 is a substantially solid type lubricating liner member 70 disposed between said outer surface 72 and such inner surface 68, preferably of the type manufactured by Kahr Bearing Co. under the Tradename "KARLON".

Depending upon the environment for which the race is being used, an adhesive material, brazing material, or any type of well known securing material may be used to secure the one piece race member in place. For example, in the railroad industry, a securing material must be used which can sufficiently withstand the forces exerted on the coupling device during use in the railway vehicle so as to ascertain that the one piece race member 63 remains secured within the aperture 56 of the male connection member 50. This securing material may be inserted between the outer surface 69 of the one piece race member 63 and the inner surface of aperture 56 of the male connection member 50. An additional option, depending upon the material used to form the one piece race member 63, would be for this one piece race member 63 to be welded or fused within the aperture 56 of the male connection member 50.

In some applications for a ball and race assembly, it may be desirable as an alternative technique for securing a thermoset resin impregnated polymeric and/or composite type one piece race member 63 within an aperture would be to partially cure the thermoset resin in the race member 63 during production. Then, during assembly of the spherical member 58, having the one piece race member 63 integrally formed thereon, within a connection assembly, fully curing the resin such that this resin bonds the one piece race member 63 within the aperture.

Another essential component of such slackless type coupler assembly 10, according to the present invention, is a first pair of wedge means, generally designated 80. In the presently preferred embodiment, such first pair of wedge means 80 includes a first wedge member 82 and a second wedge member (not shown). As best seen in FIG. 2, each of such first wedge member 82 and the second wedge member has a bolt 84 disposed therethrough in a substantially longitudinal direction and washer 86. The first wedge member 82 includes the first tapered surface 74 engaged with the first flat surface portion 64 of such radially opposed and substantially flat surface portions 64 formed on such pair of shaft members 60 and a substantially flat and vertically disposed second surface 76 which is engaged with a mating vertical surface 78 disposed on such first opening 40 formed through the first one of such pair of side wall portions 34.

The second wedge member (not shown) but, preferably, substantially identical to such first wedge member 82 includes a tapered surface engaged with a second flat surface portion of such radially opposed and substantially flat surface portions 64 formed on the pair of shaft members 60 and a substantially flat and vertically disposed surface on such second wedge member is engaged with a mating surface disposed on such second opening 42 formed through the second one of such pair of side wall portions 34.

The final essential element of the slackless type coupler assembly 10 of the instant invention is a coupler bias means, generally designated 100, best shown in FIGS. 1 and 2, for maintaining coupler knuckle 53 in a substantially vertical direction, yet allowing male connection member 50 movement flexibility as such railway vehicle is traveling over a hill. In the preferred embodiment such bias means 100 is a telescoping spring 100 including a stationery member 102 having a third pivot 104 and a telescoping member 106 having a fourth pivot 108. Such telescoping spring 100 is pivotally coupled to a first pivot 31 at a third pivot 108 and further pivotally coupled to such second pivot 55 at a fourth pivot 108 with a pair of pivot pins 110. Such telescoping member 106, moves in either outwardly or inwardly directions in respect to the stationery member 102 as the railway vehicle is traveling over the hill and moves to its predetermined position to maintain such coupler knuckle 53 in a substantially vertical direction. As can be seen, the telescoping spring 100 maintains the male connection member 50 in a suspension mode.

Figure 5:
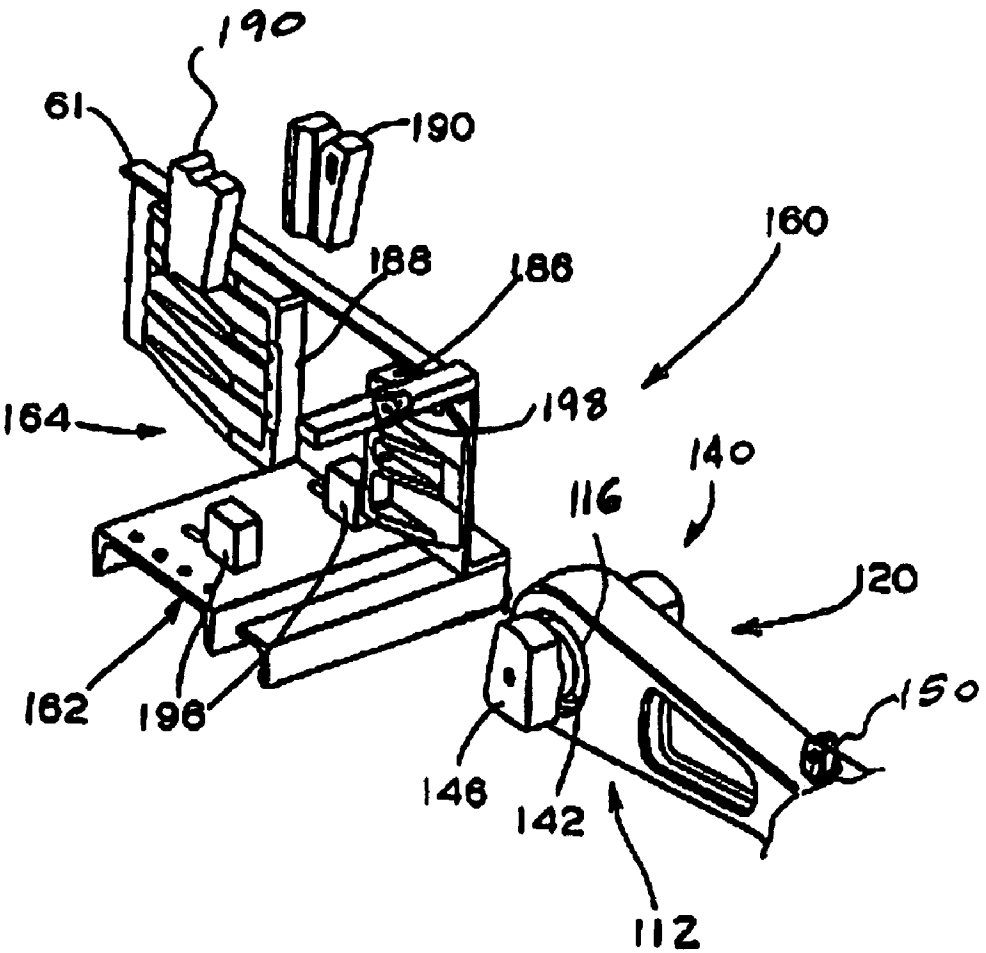
FIG. 5 is an expanded view of a slackless coupler assembly of a second embodiment using the connection assembly of the present invention prior to insertion of the male connection member of the coupler assembly into the female connection member.
Figure 6:
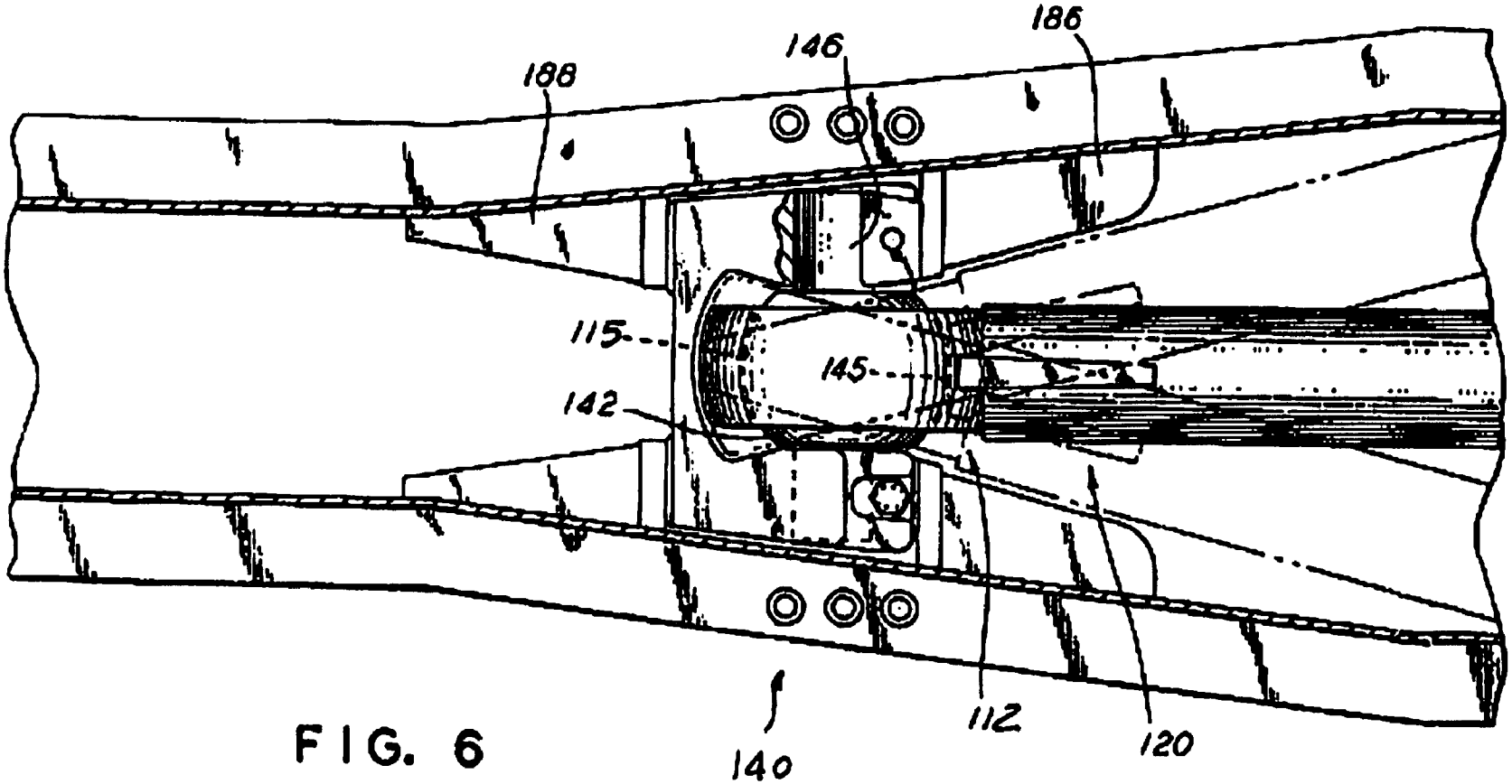
FIG. 6 is a top view of the connection assembly of a slackless coupler assembly wherein the male connection member of the coupler assembly has been joined with the female connection member.

Reference is now made, more particularly, to FIGS. 5 and 6. Illustrated therein are the essential components of another embodiment of a slackless coupler assembly, generally designated 160.

This slackless coupler assembly 160 includes a car connection member or female connection member, generally designated 164, which is engageable via a carrier plate 162 in one end of a center sill member 161. The carrier plate 162 can be secured with such center sill member 161 by any well known means, such as, for example with a bolt and lock nut assembly. The center sill member 161 is secured to a bottom portion of a car body member (not shown) of a railway car (not shown).

The car connection member 164, generally includes a pair of front and a pair of rear draft stops 186 and 188, respectively, locking wedges 190, a pair of shaft members 146 and shaft member supports 196. The locking wedges 190 may be separate members or may be a single machined or cast piece wherein the locking wedges are connected by a bridge member (not shown)

Filler blocks (not shown) may be included between the rear draft stops 188 and the locking wedges 190 to retrofit some of the longer, older coupler systems to systems capable of using the connection assembly of the present invention. A substantially spherical shaped member 142 is secured to the shaft members 146 by any well known means. These shaft members 146 are securable with the car connection member 164 through shaft member supports 196. A first pivot 198 is provided for pivotably coupling to the third pivot (not shown) of the coupler bias means (not shown).

A male connection member, generally designated 120, having a first end, generally designated 112 and a second end, generally designated (not shown) for connection to an end of the adjacent railway car (not shown), is provided. An aperture 116, having a predetermined size and a predetermined shape, is formed through a predetermined portion of the first end 112 to form a substantially cylindrical inner surface 115 within the male connection member. This aperture 116 has a longitudinal axis 154 that is disposed transverse to a longitudinal axis of the male connection member 120 and lies in a substantially horizontal plane.

The slackless type coupler assembly 160 includes a connection means 140, which is similar to the member 57, shown in FIGS. 1-3, and discussed in detail above. Such connection means 140 includes a substantially spherical member 142, having a predetermined diameter. At least a predetermined portion of such spherical member 142 is positioned within such aperture 116 formed through the predetermined portion of the first end 112 of male connection member 120.

A one piece race member 145 is formed integrally with the spherical member 142 by any well known technique, as discussed in detail above. Such one piece race member 145 which is positioned about at least a portion of the spherical member 142 is inserted within the aperture 116 of the male connection member 120 and secured therein by any well known and/or previously mentioned means as discussed in detail above.

Figure 7:
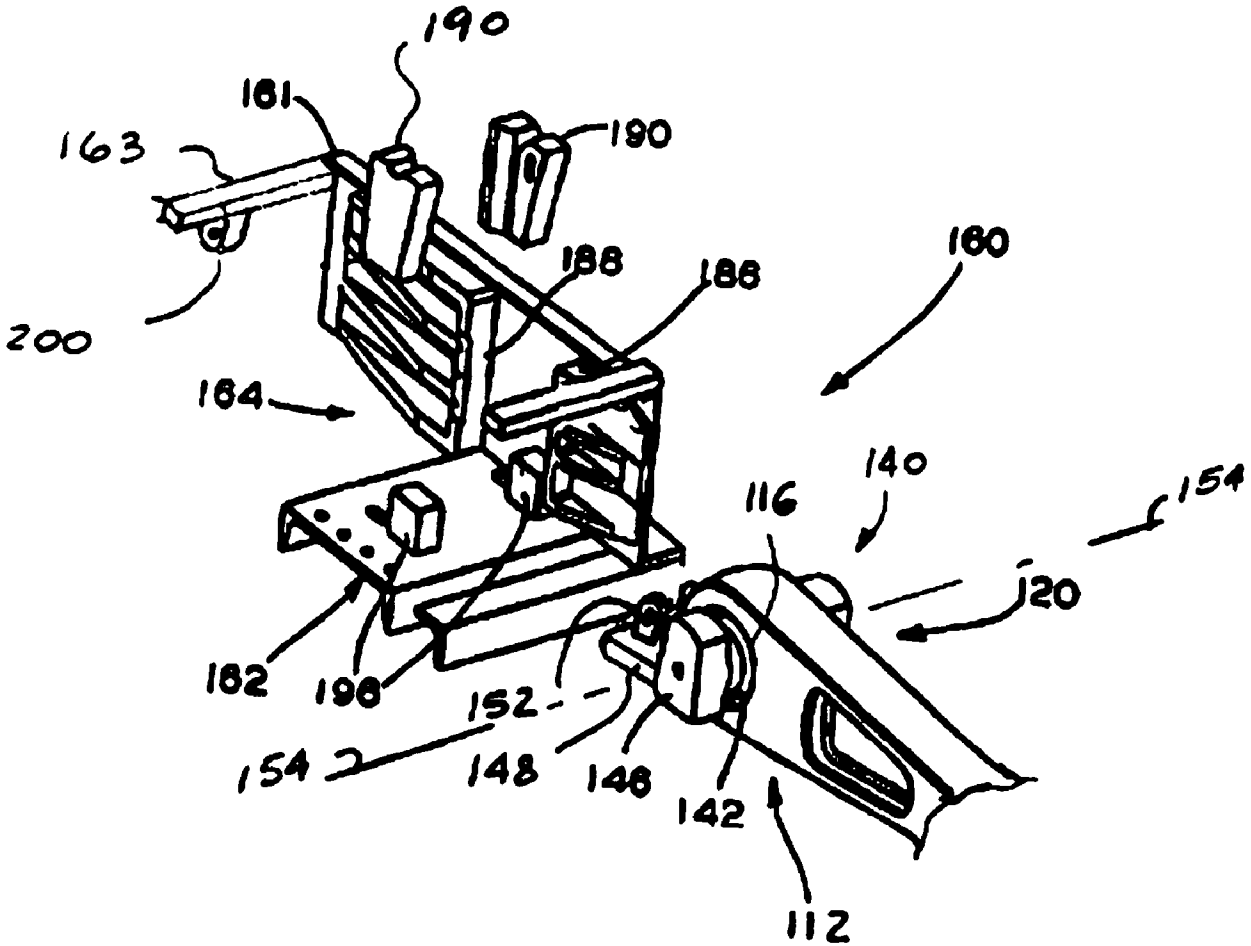
FIG. 7 is an expanded view of a slackless coupler assembly using the connection assembly of the present invention prior to insertion of the male connection member of the coupler assembly into the female connection member, further illustrating alternative attachment of the coupler bias means.

An alternative attachment of the coupler bias means 100 is illustrated in FIG. 7. A member 163 of the center sill 161 having a first pivot 200 is disposed adjacent rear draft stop 188. An end portion 148 having a second pivot 152 is disposed outwardly from the first end 112 toward the first pivot 200 and protrudes into the center sill 161. Attachment of the coupler bias means 100 is accomplished in a manner as described above. It will be understood that the coupler bias means 100 would exert a predetermined force on the male connection member 120 to maintain the coupler knuckle in a substantially vertical direction.

In a further alternative embodiment, the end portion 148 can be of a predetermined weight and configuration to establish a center of gravity of the male connection member 120 along the longitudinal axis 154 of a connection assembly 140. The end portion 148 will then enable the first end 112 to counterbalance the second end (not shown) along the longitudinal axis 154 and maintain coupler knuckle (not shown) in the substantially vertical direction. Pivoting of the male connection member 120 about the longitudinal axis 154 would enable such railway vehicle to travel over the hills.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

I claim:

1. A slackless coupler assembly for connecting adjacent ends of a pair of railway cars together, said slackless coupler assembly comprising:

(a) a female connection member having a first end of a first predetermined configuration, said first end disposed within said center sill, said female connection member further having a radially opposed second end extending outwardly from said center sill and having a cavity being open adjacent at least a portion of a bottom and an outer end of said radially opposed second end;

(b) a male connection member having a first end convex shaped in both a vertical and a horizontal direction, said first end being movably disposed within said cavity of said female connection member, said first end having a generally round aperture of a first predetermined diameter, said male connection member further having a second end radially opposed to said first end and having a coupler knuckle;

(c) a connection means at least partially disposed within said aperture for pivotably joining said male connection member to said female connection member; and (d) a coupler bias means disposed in a vertical plane within said slackless coupler assembly for maintaining said coupler knuckle in a substantially vertical direction, said coupler bias means having a first end thereof pivotally attached to said second end of said female connection member and having an opposed second end thereof pivotally attached to said male connection member between ends thereof.

2. A slackless coupler assembly according to claim 1, wherein said cavity disposed within said female connection member includes:

(a) an inner surface of a back wall portion having a second predetermined configuration which is generally concave in both a vertical direction and a horizontal direction (b) an inner surface of a top wall portion having a first pivot disposed therein; and (c) an inner surface of a pair of side wall portions having a third predetermined configuration which is generally convex shaped in both a horizontal and vertical direction;

(d) a first opening, having a fourth predetermined configuration, formed through a first one of said pair of side wall portions, said fourth predetermined configuration having at least a generally round portion and a generally open bottom portion; and (e) a second opening radially opposed to said first opening, having a fifth predetermined configuration, formed through a second one of said pair of side wall portions, said fifth predetermined configuration having at least a generally round portion and a generally open bottom portion.

3. A slackless coupler assembly according to claim 1, wherein said connection means includes:

(a) a spherical shaped member, at least a portion of said spherical shaped member being disposed within said aperture formed through said first end of said male connection member;

(b) a pair of substantially horizontally disposed shaft members extending outwardly for a predetermined distance from radially opposed and substantially vertically disposed outer surface portions of said spherical shaped member, at least a portion of a first one of said pair of shaft members being disposed within said first opening formed through said first one of said pair of side wall portions of said cavity of said female connection member, and at least a portion of a second one of said pair of shaft members being disposed within said second opening formed through said second one of said pair of side wall portions of said cavity of said female connection member, each respective one of said pair of shaft members has a radially opposed and substantially flat surface portion formed thereon;

c) a pair of first wedge means, a first surface of a first one of said pair of wedge means being engaged with a first one of said radially opposed and substantially flat surface portions formed on said pair of shaft members and a second surface of said first one of said pair of wedge means being engaged with a substantially flat and vertically disposed surface portion formed on said first one of said pair of side wall portions adjacent a portion of said first opening and a first surface of a second one of said pair of wedge means being engaged with a second one of said radially opposed and substantially flat surface portions formed on said pair of shaft members and a second surface of said second one of said pair of wedges means being engaged with a substantially flat and vertically disposed surface portion formed on said second one of said pair of side wall portions adjacent a portion of said second opening;

(d) a one piece race member formed integrally on said spherical member in a manner so as to enable rotational movement of said spherical member with respect to said one piece race member, said race member and said spherical member capable of being inserted within said aperture of said male connection member enabling movement of such male connection member in relation to such female connection member in both a vertical direction and a horizontal direction over a predetermined range of angles;

(e) means for securing said one piece race member within said aperture; and (f) means for joining said spherical member to such male connection member so as to facilitate a connection of adjacent ends of such pair of railway vehicles.

4. A slackless coupler assembly as recited in claim 3, wherein said one piece race member is a filament wound composite material.

5. A slackless coupler assembly, as recited in claim 4, wherein said one piece race member is formed by filament winding thermoset resin impregnated fibers about a polymeric or composite base and partially curing said resin impregnated fibers.

6. A slackless coupler assembly, as recited in claim 5, wherein at least a portion of said means for securing said one piece race member within said aperture includes fully curing said one piece race member after insertion into said aperture of said male connection member.

7. A slackless coupler assembly, as recited in claim 3, wherein said means for securing said one piece race member within said aperture is a circular ring one of adhesive bonded, welded and brazed to said male connection member.

8. A slackless coupler assembly, as recited in claim 3, wherein an outer surface of said one piece race member has a substantially identical size and shape as an inner surface of said aperture formed in said male connection member.

9. A slackless coupler assembly, as recited in claim 3, wherein a lubricating means selected from a solid type lubricating liner and a non solid lubricating material is disposed between said spherical member and said one piece race member.

10. A slackless coupler assembly, as recited in claim 3, wherein said spherical shaped member includes a polished chrome plating on at least a portion of an outer surface thereof.

11. A slackless coupler assembly, as recited in claim 3, wherein said pair of wedge means includes first and second wedge members, each of said first and second wedge members having a bolt disposed therethrough in a longitudinal direction and a washer, said first wedge member includes said tapered surface engaged with said first flat surface portion formed on said pair of shaft members and said first wedge member includes said substantially flat and vertically disposed surface engaged with said mating vertical surface disposed on said first opening formed through said first one of said pair of side wall portions and a second one of said first and second wedge members includes said tapered surface engaged with said second flat surface portion formed on said pair of shaft members and said second wedge member includes said substantially flat and vertically disposed surface engaged with said mating vertical surface disposed on said second opening formed through said second one of said pair of side wall portions.

12. A slackless coupler assembly according to claim 1, wherein said coupler bias means is a telescoping spring carrying said first and second ends of said coupler bias means and having a movable telescopic member, said telescoping member moving in either outwardly or inwardly directions relative to said female connection member as such railway vehicle is traveling over a hill, said telescoping member moving to its predetermined position to maintain said coupler knuckle in a substantially vertical direction.

13. A slackless coupler assembly for connecting adjacent railway cars having a center sill secured to the bottom of such railway cars, said slackless coupler assembly comprising:

(a) a female connection member engageable with such center sill by a carrier plate, said carrier plate having a pair of shaft member supports and a first pivot disposed thereon;

(b) a pair of rear draft stops;

(c) a pair of front draft stops;

(d) a pair of locking wedges;

(e) a male connection member having a first end convex shaped in both a vertical and a horizontal direction, said first end being movably disposed within female connection member, said first end having an generally round aperture of a first predetermined diameter, said aperture having a longitudinal axis disposed transversly to a longitudinal axis of said male connection member, said male connection member further having a radially opposed second end having a coupler knuckle (f) a connection means at least partially disposed within said aperture for pivotably joining said male connection member to said female connection member; and (g) a coupler bias means disposed in a vertical plane within said slackless coupler assembly for maintaining said coupler knuckle in a substantially vertical direction, said coupler bias means having a first end thereof pivotally attached to one of such center sill and said female connection member and having an opposed second end thereof pivotally attached to said male connection member adjacent said first end thereof.

14. A slackless coupler assembly according to claim 13, wherein said connection means including:

(a) a spherical shaped member having at least a portion disposed within said aperture formed through said first end of said male connection member;

(b) a pair of substantially horizontally disposed shaft members extending outwardly for a predetermined distance from radially opposed and substantially vertically disposed outer surface portions of said spherical shaped member, said shaft members secured to said shaft supports disposed within said female connection member;

(c) a one piece race member formed integrally said spherical member in a manner so as to enable rotational movement of said spherical member with respect to said one piece race member, said race member and said spherical member capable of being inserted within said aperture of said male connection member enabling movement of such male connection member in relation to such female connection member in both a vertical and a horizontal direction over a predetermined range of angles;

(d) means for securing said one piece race member within said aperture; and (e) means for joining said spherical member to said male connection member so as to facilitate a connection of adjacent ends of such pair of railway vehicles.

15. A slackless coupler assembly as recited in claim 14, wherein said one piece race member is a filament wound composite material.

16. A slackless coupler assembly, as recited in claim 15, wherein said one piece race member is formed by filament winding thermoset resin impregnated fibers about a polymeric or composite base and partially curing said resin impregnated fibers.

17. A slackless coupler assembly, as recited in claim 16, wherein at least a portion of said means for securing said one piece race member within said aperture includes fully curing said one piece race member after insertion into said aperture of said male connection member.

18. A slackless coupler assembly, as recited in claim 14, wherein an outer surface of said one piece race member has a substantially identical size and shape as an inner surface of said aperture formed in said male connection member.

19. A slackless coupler assembly, as recited in claim 14, wherein said spherical shaped member includes a polished chrome plating on at least a portion of an outer surface thereof.

20. A slackless coupler assembly according to claim 13, wherein said coupler bias means is a telescoping spring carrying said first and second ends of said coupler bias means and having a movable telescopic member, said telescoping member moving in either outwardly or inwardly directions relative to said female connection member as such railway vehicle is traveling over a hill, said telescoping member moving to its predetermined position to maintain said coupler knuckle in a substantially vertical direction.

* * * * *